United States Patent [19]

Siekawitch

[11] Patent Number: 4,916,993

[45] Date of Patent: Apr. 17, 1990

[54] ADJUSTABLE OIL FILTER WRENCH

[76] Inventor: Gary J. Siekawitch, 2222 3rd Ave. SW., Rochester, Minn. 55902

[21] Appl. No.: 270,615

[22] Filed: Nov. 14, 1988

[51] Int. Cl.[4] ..... B25B 13/52

[52] U.S. Cl. ..... 81/64; 81/3.43

[58] Field of Search ..... 81/3.43, 64, 65

[56] References Cited

U.S. PATENT DOCUMENTS

| | | | |
|---|---|---|---|
| 2,498,582 | 2/1950 | Schoenberger | 81/3.43 X |
| 4,257,288 | 3/1981 | Bianco | 81/64 X |
| 4,660,445 | 4/1987 | Windon | 81/3.43 |

FOREIGN PATENT DOCUMENTS

| | | | |
|---|---|---|---|
| 120247 | 8/1926 | Switzerland | 81/3.43 |

*Primary Examiner*—James G. Smith

*Attorney, Agent, or Firm*—Leon Gilden

[57] ABSTRACT

An adjustable oil filter wrench is set forth including an adjustable strap accommodating oil filters of varying diameters with said straps secured to an aligned handle provided with an arcuate saddle for accepting an adjustably pivotal band therein for application of torque to said band over a substantial circumferential surface of an oil filter upon pivotally clamping of the band about the oil filter.

5 Claims, 2 Drawing Sheets

ADJUSTABLE OIL FILTER WRENCH

BACKGROUND OF THE INVENTION

1. Field of the Invention

The field of invention pertains to wrenches, and more particularly pertains to that class of oil filter wrenches particularly adapted for the removal and installation of automotive type canister oil filters.

2. Description of the Prior Art

Oil filter wrenches are of a class of tool that is indispensable in contemporary automotive environments. An automotive type oil filter canister, even when secured to an automotive engine in a hand-tight torquing procedure, the normal heating and contraction of the oil filter cannister in use of the automobile tends to tighten the oil filter to the automobile engine making manual removal very difficult, if not impossible. Consequently, oil filter wrenches are utilized and come in a variety of types such as a band type using an encircling band about the oil filter, or an over-the-end socket type and the like.

Modern automobiles in the evolution of development are currently utilizing oil filters of varying diameters. As a consequence, a mechanic must have on hand a variety of such oil filter wrenches and keep them in order. This is not always possible due to the nature of business and is a further complication to a business environment as well as an individual who performs an oil filter change as a manner of routine maintenance. Examples of encircling type wrenches are set forth for example in U.S. Pat. No. 1,388,083 to Workman wherein a pivoted band provided with serrated interior is formed with associated handles for gripping about a lid of a container. The Workman patent, as is typical of the prior art, provides no basis for adjustment.

U.S Pat. No. 3,964,115 to Platek sets forth a band type wrench of a relatively complex and elaborate construction utilizing a flaccid belt that is adjustable dependent on the diameter of objects to be rotated. Unfortunately, the Platek patent and the use of a flaccid loop is not of a convenient organization due to the need to manipulate and maneuver a loop that does not maintain its configurational integrity when positioned and oriented within a confined engine compartment and furthermore is of a rather extensive structural organization that limits its accessability within contemporary tight engine compartments.

U.S. Pat. No. 4,350,063 to Koehler sets forth a spring band of material adjustable for diameter by use of a worm screw engageable with slots on the band wherein the worm screw forms an extension that is a shank of a twist tool. The Koehler patent is of limited strength and will tend to deform and bind the manipulation of canister type oil filters as the worm screw and shank are offset and tangential to the band and fail to provide a circumferential pressure over an extended surface of the band material, as does the instant invention.

U.S. Pat. No. 4,506,568 to Aamodt sets forth a strap wrench that is adjustable by means of a two-part twisting interengageable socket arrangement to adjust the loop diameter of a strap wrench, as may be typically utilized for removal of oil filters, but is of similar structural limitations as other the prior art as in the Platek patent and the use of flaccid loops in the manipulation of automotive oil filters.

U.S. Pat. No. 4,552,040 to Bang sets forth a loop wherein the ends thereof are relatively positionable relative to one another by means of a threaded shank and is of a similar organization to that as the Koehler patent wherein the torque application handle is tangentially offset relative to the surface of an associated oil filter and thereby tends to bind and limit the strength of such wrenches.

As may be appreciated, there continues to exist a need for a new and improved adjustable oil wrench that provides the features of adjustability, strength, and application of circumferentially applied force directly to the surface of an oil filter, and in this respect, the present invention substantially fulfills this need.

SUMMARY OF THE INVENTION

In view of the foregoing disadvantages inherent in the known types of oil filter wrenches now present in the prior art, the present invention provides an adjustable oil wrench wherein the same may be readily manipulated and adjusted for accommodation of oil filters of varying diameters. As such, the general purpose of the present invention, which will be described subsequently in greater detail, is to provide a new and improved adjustable oil wrench which has all the advantages of the prior art adjustable oil wrenches and none of the disadvantages.

To attain this, the present invention comprises a relatively circumferentially adjustable narrow band of spring-like material formed with a series of parallel spaced grooves for engagement by a tangentially offset worm gear wherein a first end of the loop is formed as a bifurcated strip with a plurality of legs securable about a first pair of aligned upstanding bosses on either side of the filter wrench handle wherein the handle is formed with an arcuate recess of complementary configuration to the loop to allow arcuate pivoting of a further end of the band secured to a pivoting saddle spaced above the recess. The saddle is pivotally secured to a second pair of bosses spaced from the first boss pair about the arcuate recess.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent o legal terms or phraseology, to determine quickly from a cursory inspection the nature and essence of the technical disclosure of the application. The abstract is neither intended to define the invention of the application which is measured by the claims, nor is it intended to be limiting as to the scope of the invention in any way.

It is therefore an object of the present invention to provide a new and improved adjustable oil wrench which has all the advantages of the prior art adjustable oil wrenches and none of the disadvantages.

It is another object of the present invention to provide a new and improved adjustable oil wrench which may be easily and efficiently manufactured and marketed.

It is a further object of the present invention to provide a new and improved adjustable oil wrench which is of a durable and reliable construction.

An even further object of the present invention is to provide a new and improved adjustable oil wrench which is susceptible of a low cost of manufacture with regard to both materials and labor, and which accordingly is then susceptible of low prices of sale to the consuming public, thereby making such adjustable oil wrenches economically available to the buying public.

Still yet another object of the present invention is to provide a new and improved adjustable oil wrench which provides in the apparatuses and methods of the prior art some of the advantages thereof, while simultaneously overcoming some of the disadvantages normally associated therewith.

Still another object of the present invention is to provide a new and improved adjustable oil wrench wherein the same is provided with an adjustable spring-like steel band provided with an independent band adjustment means and a handle formed with an arcuate recess for accommodation of a substantial arc of a pivoting saddle securing said band for imparting torque to said band and oil filter upon pivoting engagement of the band with the filter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
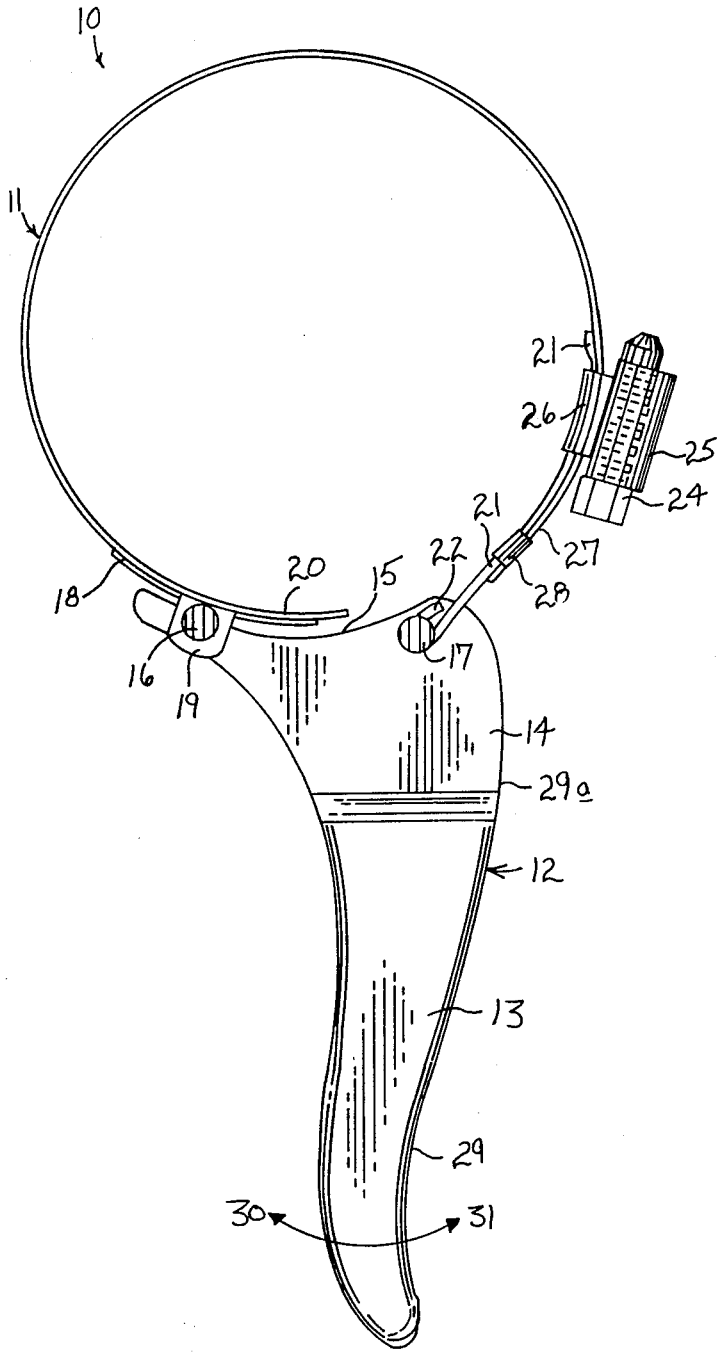
FIG. 1 is an orthographic taken in elevation of the instant invention.
Figure 2:
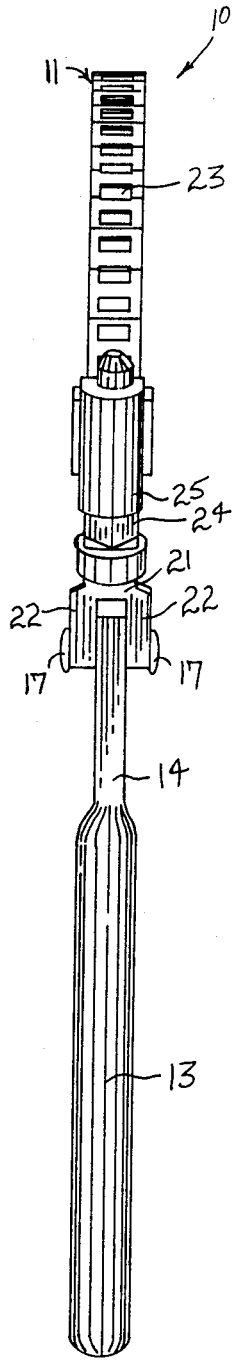
FIG. 2 is an orthographic side view taken in elevation of the instant invention.
Figure 3:
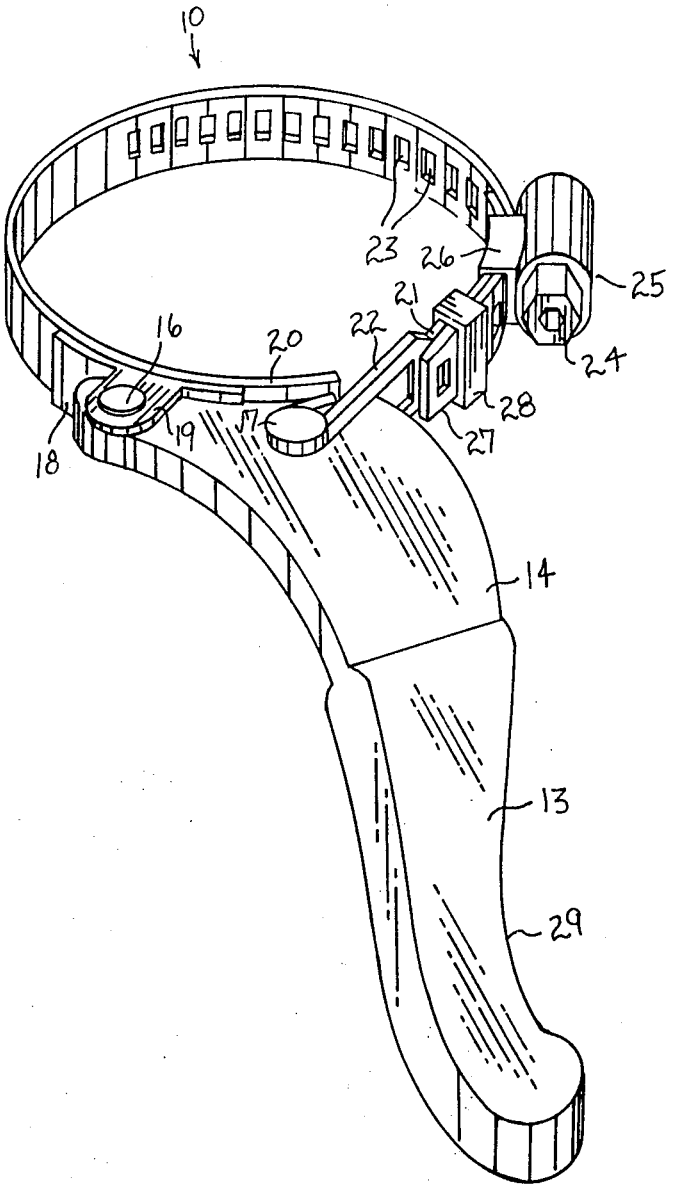
FIG. 3 is an isometric illustration of the instant invention.

With reference now to the drawings, and in particular to FIGS. 1 to 3 thereof, a new and improved adjustable oil wrench embodying the principles and concepts of the present invention and generally designated by the reference numeral 10 will be described.

More specifically, it will be noted that the adjustable oil wrench 10 essentially comprises an adjustment strap 11 and an associated generally "S" shaped handle member 12.

A handle member 12 includes enlarged lower handle grip portion 13 integrally formed to a narrower shank upper handle portion 14 of an increased width measured circumferentially relative to the associated strap 11 relative to the lower handle portion 13. The upper handle portion 14 is formed with an arcuate concave recess 15 formed within an upper terminal end of the upper handle portion 14. A first pin boss pair 16 are orthogonally secured to opposite sides of the upper handle portion proximate a forward end of the arcuate recess 15 with a second boss pair 17 projecting orthogonally and spaced from the first boss pair 16 proximate a further end of the arcuate recess 15.

A pivoting saddle 18 has integrally secured thereon a first terminal end portion 20 of strap 11. The pivoting saddle 18 includes a concave arcuate recess to accept the first end portion 20 at a space above the arcuate recess 15 by a plurality of downwardly depending saddle legs 19 on opposite sides of the handle 14 and pivotally secured to respective ones of the first boss pair 16.

A bifurcated clamping strap 21 includes a plurality of strap legs 22 each secured about a respective one of the second boss pair 17 and pivotally mounted thereon with the clamping strap 21 secured to an underlying band 26 of a worm gear housing 25. The clamping strap 21 may be secured to the band 26 by adhesives, mechanical clamping or the like. The adjustment strap 11 is formed with a parallel series of strap openings 23 to cooperate with the threaded worm gear 24 rotatably mounted within the gear housing 25 and upon rotation of the worm screw 24, the second terminal end portion 27 of strap 11 is circumferentially repositioned relative to the clamping strap 21 and the gear housing 25 to vary the diameter of the adjustment strap 11. A guide strap 28 slidably encompasses the second terminal end portion of strap 27 of strap 11 and the bifurcated clamping strap 21 to secure the second terminal end portion 27 and avoid interference of the second terminal end portion 27 when the apparatus 10 is utilized in confined working areas.

The handle is further formed with an arcuate lower portion 29 of the generally "S" shaped handle communicating with an arcuate upper portion **29*a* of a reverse curve linear shape to the lower portion 20 to effect a comfortable recess at the portion 20** for accommodating a user's hand and grip.

It may be appreciated therefore that the instant invention may readily and easily accommodate a variety of oil filter wrench diameters and accordingly replace a plurality of such wrenches with a single effective and durable construction.

It is also to be noted that the width of the strap 11, as illustrated in FIG. 2 is of substantially the same width of the enlarged lower handle portion 13 to present a tool of increased maneuverability within the restricted access areas available in contemporary automobile construction.

In use, upon positioning of the strap 11 on an oil filter to be torqued, the worm screw 24 is rotated to enlarge or reduce the diameter of the strap 11 and upon positioning of the strap 11 and rotation of the handle 12 in a first direction 30, clamping is effective whereupon rotation in a second direction 31 disengages the strap 11 relative to an associated filter. It is to be further noted that the strap 11 is of relatively flexible construction to enable such adjustment as noted whereupon the saddle 18 is of a relatively rigid construction to provide desired rigidity to the first terminal end portion 20 as it is secured to the saddle 18.

As to the manner of usage and operation of the present invention, the same should be apparent from the above description. Accordingly no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, aIl suitable modifications and equivalents may be resorted to, falling within the scope of the invention.

What is claimed as being new and desired to be protected by LETTERS PATENT of the United States is as follows:

1. An oil filter wrench comprising a substantially circular strap means for encircling engagement of an oil filter canister including a metallic strap of a predetermined width including a series of slots spaced along said strap means, and said strap means including a fixed first end and a relatively movable second end with a housing overlying said second end for overlying said slots and for effecting movement of said second end relative to said first end upon rotation of a worm screw rotatably mounted within said housing, and elongate handle means including a saddle means pivotally mounted thereto for securing said first end to said handle means at a first position, and said elongate handle means including an arcuate concave recess at an upper terminal end thereof for enabling pivotment of said saddle means relative to said recess and wherein said saddle means overlie said arcuate concave recess, and a bifurcated flexible outer strap securing said housing to said handle means at a second and said housing secured adjacent a remote terminal end of said outer strap spaced from siad handle means, wherein said bifurcated flexible outer strap includes a first leg and a second leg wherein said first and second legs are pivotally secured to aligned second bosses, wherein said second bosses project orthogonally relative to said handle means, and said saddle means includes a plurality of legs projecting downwardly from said saddle means straddling said handle means and pivotally secured to respective aligned first bosses projecting orthogonally relative to said handle means wherein said first bosses are positioned proximate a first end of said arcuate recess and said second bosses are positioned proximate a second end of said arcuate recess remote from said first and adjacent opposite respective ends of said arcuate recess, and wherein said housing means further includes an underlying band wherein said underlying band has integrally secured therewithin a terminal end portion of said bifurcated flexible outer strap remote from said second bosses and slidingly accepts therethrough said second end of said strap means.

2. An oil filter wrench as set forth in claim 1 wherein a lowermost portion of said handle means includes an enlarged gripping portion of a width substantially equal to that of said strap means.

3. An oil filter wrench as set forth in claim 2 wherein said handle means is of a generally "S" shaped configuration defining a lowermost concave force receiving surface on said lowermost portion of said handle means.

4. An oil filter wrench as set forth in claim 3 wherein said first bosses are parallel to said second bosses and said first and second bosses are orthogonally and integrally secured to an uppermost portion of said handle means.

5. An oil filter wrench as set forth in claim 4 wherein said saddle means is of a concave arcuate configuration and formed generally of rigid material for accepting said strap means wherein said strap means is formed of a relatively flexible material.

* * * * *